US006895865B2

(12) United States Patent
Bond

(10) Patent No.: US 6,895,865 B2
(45) Date of Patent: May 24, 2005

(54) SABOT FOR MUZZLELOADING FIREARM

(75) Inventor: Ronald D. Bond, Grand Island, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 89 days.

(21) Appl. No.: 10/393,315

(22) Filed: Mar. 20, 2003

(65) Prior Publication Data

US 2004/0182274 A1 Sep. 23, 2004

(51) Int. Cl.[7] ..... F42B 14/00
(52) U.S. Cl. ..... 102/520; 102/364
(58) Field of Search ..... 102/520, 364, 102/525

(56) References Cited

U.S. PATENT DOCUMENTS 2,920,568 A * 1/1960 Rabinow ..... 102/208
3,107,615 A * 10/1963 Brady ..... 102/520
3,490,373 A * 1/1970 Fox ..... 102/477
4,002,123 A * 1/1977 Fisher ..... 102/208
4,644,866 A * 2/1987 Sullivan ..... 102/520
4,665,332 A * 5/1987 Meir ..... 310/77
4,936,219 A * 6/1990 Mudd ..... 102/520
5,361,701 A * 11/1994 Stevens ..... 102/520
5,485,787 A * 1/1996 Bowcutt et al. ..... 102/520
6,209,461 B1 * 4/2001 Riffet et al. ..... 102/364
6,283,032 B1 * 9/2001 Wardecki ..... 102/364

FOREIGN PATENT DOCUMENTS

GB 0001430 * 6/1856 ..... 102/525

* cited by examiner

*Primary Examiner*—Harvey E. Behrend
(74) *Attorney, Agent, or Firm*—Langlotz Patent Works, Inc.; Bennet K. Langlotz

(57) ABSTRACT

A sabot for a muzzleloading firearm has a cylindrical body aligned with a bore axis. The body has a sleeve portion extending in a first direction adapted to receive a bullet. A post extends from the body in a second direction opposite the first direction. The post may have a cross sectional profile that has articulated surfaces, and which may define channels along the post. A powder pellet defining a bore may be closely received on the post, with an interference fit retaining the pellet on the post. The sabot may be employed to extract a pellet from a storage container, by inserting the post in the pellet bore to extract the pellet from the container. The sabot may be part of an assembly including a bullet and a pellet, which may be loaded into the muzzle of a rifle as a single unit.

20 Claims, 4 Drawing Sheets

SABOT FOR MUZZLELOADING FIREARM

FIELD OF THE INVENTION

This invention relates to muzzleloading firearms, and more particularly to sabots for use with cylindrical gunpowder pellets.

BACKGROUND AND SUMMARY OF THE INVENTION

Muzzleloading firearms operate in a traditional manner employed before the development of integrated ammunition cartridges, and remain popular among some hunters, target shooters, and historical enthusiasts. A muzzleloading rifle is loaded by insertion of powder and a bullet into the muzzle (forward aperture) of the rifle for each shot. Modern muzzleloaders employ pre-manufactured cylindrical pellets of gunpowder to provide a convenient and carefully-sized charge. The bullet normally includes a sabot, which is a plastic cup that encompasses the sides and rear of the bullet, to facilitate insertion of the bullet with minimal friction and force. Without a sabot, the bullet must be large enough to engage the barrel rifling upon firing, which means that the bullet must be forcibly deformed by the rifling as it is inserted, requiring unwanted force. With a sabot, the plastic readily deforms to engage the rifling on insertion, and engages the rifling on discharge to rotate the bullet to provide stable flight. The sabot peels off the bullet after it leaves the muzzle.

Existing muzzleloading requires several steps. First, the shooter must obtain the powder pellets from the package in which they are purchased. A typical pellet is a straight cylinder having a central axial bore. A typical package is a box in which a matrix of pellets are packed, stacked two deep. It can be difficult to extract pellets by hand, especially with cold or clumsy fingers. Consequently, the manufacturer includes a "pipe-cleaner" tool in each box, so that it can be inserted in the bore of one or two pellets in a stack, with friction forces drawing the pellets from the box. The pellets can then be inserted in the barrel muzzle, and the pipe-cleaner removed for future use. This process is cumbersome and inconvenient, and becomes even more difficult if the pipe-cleaner is lost.

In addition, existing loading techniques present a risk of potentially dangerous loading errors. For instance, a shooter loading powder pellets loosely contained within a box may become distracted, and load more pellets than desired. This can lead to excessive charges than can damage the rifle, and endanger the shooter and bystanders.

After the loading of the powder pellets, the bullet, encased in its sabot sleeve, is loaded into the muzzle. For a shot in which two powder pellets are employed, three different items must be loaded into the muzzle, requiring significant time for each shot. This a particular disadvantage when a rapid second shot is desired, because two more pellets and a saboted bullet must be obtained from their carrying containers and loaded into the rifle.

Another concern with current muzzleloaders is that powder pellets may have a directionality. Some pellets are different on one end than the other, with powder of a type that facilitates ignition on one end that must be to the rear, adjacent the ignition source, facing away from the muzzle. Manual insertion of pellets taken from a container in which they are loosely received risks that such pellets are inserted backward, leading to a failure-to-fire malfunction or inconsistent performance.

The present invention overcomes the limitations of the prior art by providing a sabot for a muzzleloading firearm. The sabot has a cylindrical body aligned with a bore axis. The body has a sleeve portion extending in a first direction adapted to receive a bullet. A post extends from the body in a second direction opposite the first direction. The post may have a cross sectional profile that has articulated surfaces, and which may define channels along the post. A powder pellet defining a bore may be closely received on the post, with an interference fit retaining the pellet on the post. The sabot may be employed to extract a pellet from a storage container, by inserting the post in the pellet bore to extract the pellet from the container. The sabot may be part of an assembly including a bullet and one or more pellets, which may be loaded into the muzzle of a rifle as a single unit.

DETAILED DESCRIPTION OF A PREFERRED EMBODIMENT

Figure 1:
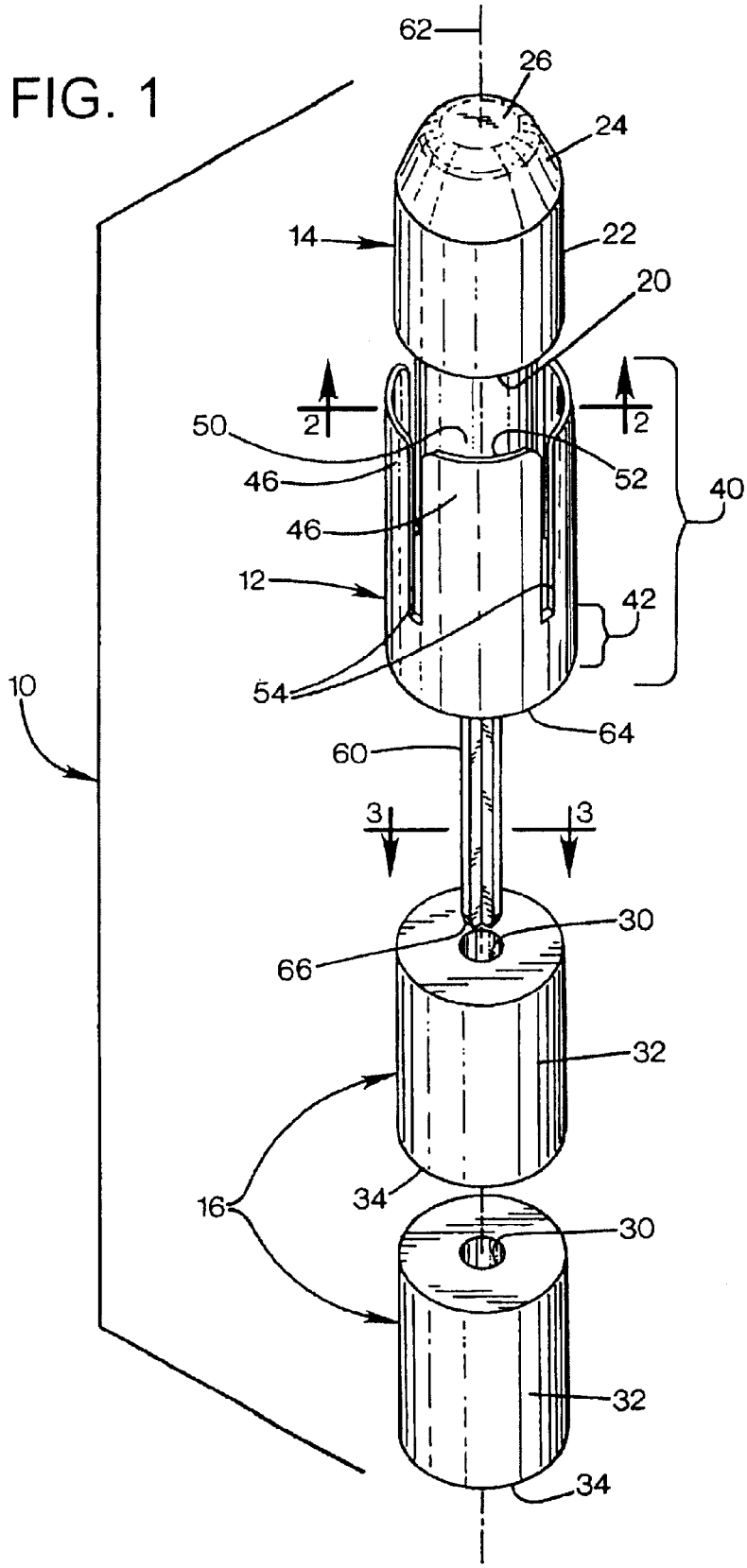
FIG. 1 is an exploded perspective view of a sabot assembly according to a preferred embodiment of the invention.

FIG. 1 shows a sabot assembly 10 that includes a sabot 12, a bullet 14, and a pair of cylindrical powder pellets 16.

In the illustrated embodiment, which is sized for a 0.50 caliber muzzleloading rifle, the bullet 14 is 0.45 caliber (0.452 inch diameter), for example a handgun bullet such as model XTP available from Hornady Manufacturing Company. The bullet has a flat base 20, a cylindrical side wall 22 extending from the base, and a tapered portion 24 terminating in a nose 26. The length of the bullet will vary with the selected profile and weight, for a given caliber. In the illustrated embodiment, a 300 grain bullet has an overall length of 0.777 inch. (Such dimensional details are provided herein to illustrate a preferred and alternative embodiments, and are not intended as limitations on the claims that define the scope of the invention.)

The powder pellets 16 are solid cylindrical bodies formed of gunpowder. In the example of the preferred embodiment, the pellets have a length of 0.725 inch, a diameter of 0.452 inch, with a central axial bore 30 having a diameter of 0.125 inch extending the length of each cylinder and coaxial with the cylindrical exterior surfaces 32. In some embodiments, the rear end face 34 of each pellet 16 may include the presence of a second type of powder integrated into or coated on the pellet's rear end, to provide a more readily ignitable surface in response to an ignition source positioned in the rifle behind the pellets. One suitable example of pellets is Hogdon type Pyrodex 50/50. In this standard and conventional type of pellet intended for use with conventional muzzleloading components, the bores 30 stack to form a flame channel that serves to facilitate progression of ignition through the entire length of a stack of pellets, so that they ignite essentially simultaneously, instead of sequentially.

The sabot 12 has a cylindrical body 40 having a diameter of 0.510 inch, sized to be closely received in a 50 caliber bore, without undue friction to impair loading. The body has a base 42 from which extend four petals 46. In alternative embodiments, there may be any number of petals, or an uninterrupted sleeve may be employed. The petals have exterior surfaces that form a cylinder contiguous with the exterior of the body, and extend a length of 0.710 from the body in the preferred embodiment. Together, the petals and base define a sleeve or cylindrical chamber space 50 having an inside diameter and length sized to closely receive the cylindrical portion 22 of the bullet 14. The bullet-receiving space 50 is open at the front, so that the bullet nose protrudes beyond the free edges 52 of the petals (same-caliber bullets with different weights, profiles and sectional densities may be recessed within or protrude from the space by different amounts.) Essentially, the petals form a sleeve divided into several parts by elongated gaps 54 that extend from the base 42 to a rim at the free edges of the petals.

The sabot includes a post 60 that extends from the base 42 in a direction opposite the petals. The post is coaxial with the bore axis 62, which also defines the axis of the bullet and sabot body exterior. The post extends beyond the lower edge 64 of the sabot body by 1.06 inch. This is adequately longer than the length of a single pellet, to allow the engagement of a second pellet in a stack. In alternative embodiments, the post may be provided in a shorter length sized to engage a single pellet without protrusion, or a longer length to at least partially engage a third pellet (or more) as needed.

The post 60 has an X-shaped cross sectional profile that will be discussed below in greater detail in conjunction with FIG. 3. The post profile is essentially constant along its length, and is closely circumscribed by a circle centered on the bore axis 62 with a diameter of slightly greater than the diameter of the pellet bores 30. Thus, in the preferred embodiment, a post diameter of between 0.125 and 0.130 inch is preferred, to provide an adequate interference fit. The post's free end 66 is slightly chamfered with an angle of 15 degrees to facilitate insertion of the post within the pellet bores. In the preferred embodiment, the sabot is formed of a flexible thermoplastic material resistant to high temperatures. In the preferred embodiment low density polyethylene is employed. In alternative embodiments medium & high density grades of polyethylene and other thermoplastics may be employed. Preferably a melting point of approximately 220° F. is preferred, which is generally suitable to withstand the higher temperatures within the firing environment due to the short duration.

Figure 2:
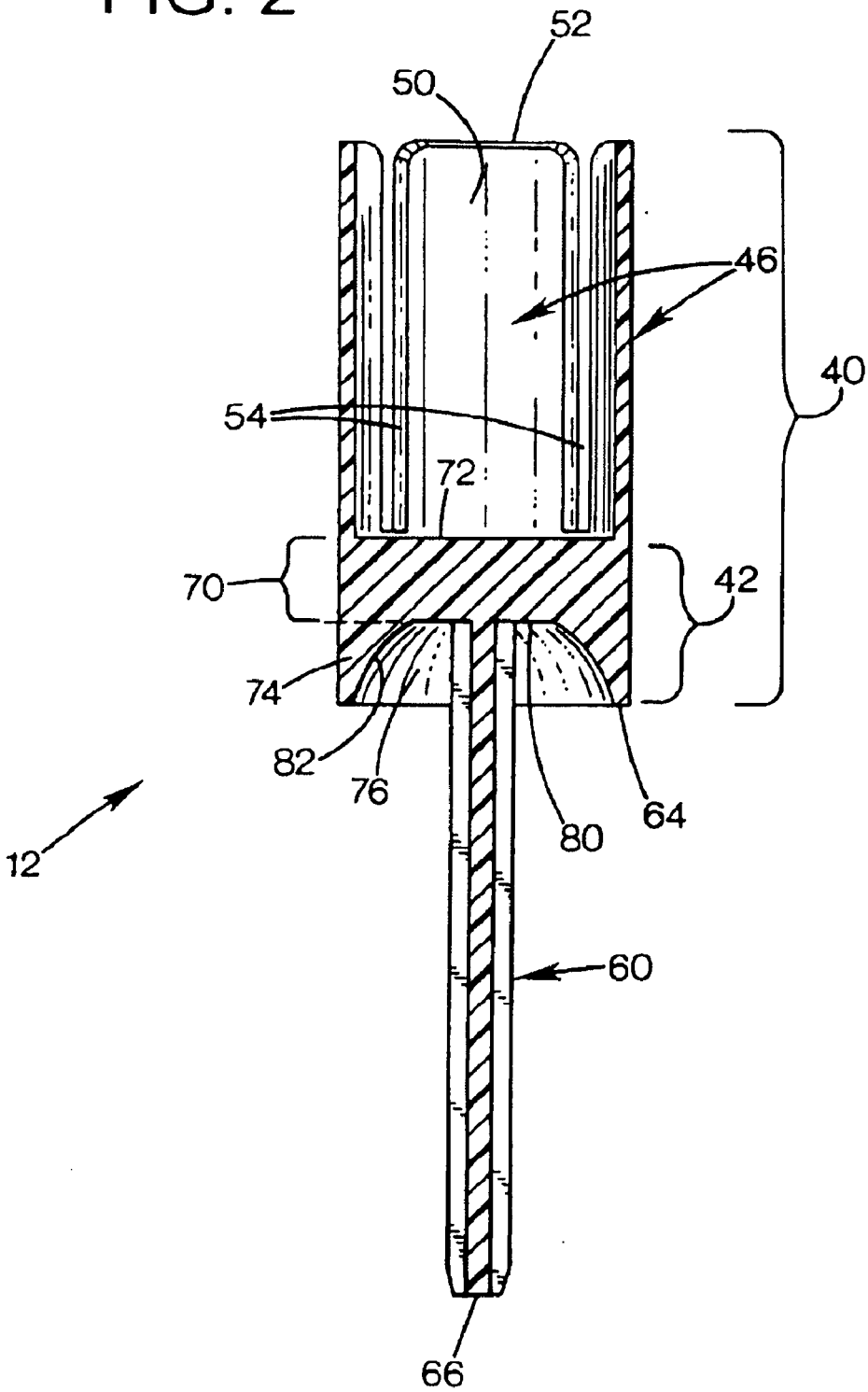
FIG. 2 is a cross sectional side view of the sabot of FIG. 1, taken along line 2—2 of FIG. 1.

As shown in FIG. 2, the sabot base 42 has a solid disc portion 70 having a front surface 72 on which rests the base of the bullet, and a rear surface from which a flange 74 extends, terminating at the lower edge 64. The flange defines the perimeter of a cup space 76, the base of which is defined by a flat rear surface portion 80 of the base portion 70. A radiused concave portion 82 surrounds the flat portion and extends to the edge 64. As with conventional sabots, the flange flares outward in response to ignition of the powder charge, so that it firmly engages the rifling of the barrel. This seals the rifled bore to prevent the escape of gases prior to the sabot/bullet assembly leaving the bore. The interference fit between the bore, petals & bullet are responsible for imparting rotation from the rifled bore to the bullet. The post 60 extends perpendicularly from the center of the flat surface 80, which has a diameter about double that of the post, and half that of the sabot exterior. The flange extends rearwardly of the surface 80 by a distance of 0.150 inch in the preferred embodiment. The cup space 76 has a diameter at the edge 64 of 0.460 inch, which is slightly larger than the pellet diameter, so that the pellet is centered with respect to the sabot not just by the post, but by the cup. Accordingly, the pellet will extend slightly into the cup.

Figure 3A:
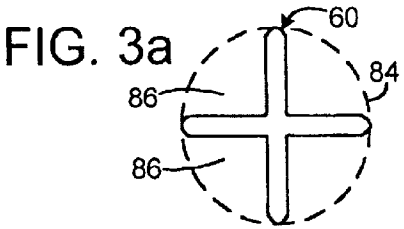
FIG. 3*a* is an axial cross sectional view of the post of the sabot of FIG. 1, taken along line 3—3 of FIG. 1.

FIG. 3*a* illustrates the preferred shape of the cross sectional profile of the post 60. The cross section has a profile that may be described as X-shaped, cross-shaped, or star-shaped (four-pointed.) The profile is circumscribed by a circle 84. Within the circle, the post has articulated surfaces that deviate substantially from the circle to define spaces 86 that form channels with respect to the pellet bore. In the illustrated embodiment, the profile has four radially extending legs, which define four channels. Each leg has a thickness of 0.030 inch. The tip of each leg has a small point (or line) of contact with the pellet bore, facilitating a slight interference fit. The small area of contact provides the relatively high pressures needed to deform the post edges, without excessive and potentially damaging force on the pellet body. In the illustrated embodiment, the ends of the legs are rounded, although these may be pointed or squared-off in alternative embodiments.

Figure 3B:
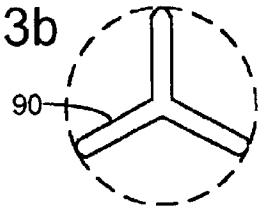
FIGS. 3*b*–3*l* are axial cross sectional views of sabot posts according to alternative embodiments of the invention.
Figure 3C:
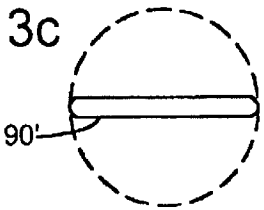
Figure 3D:
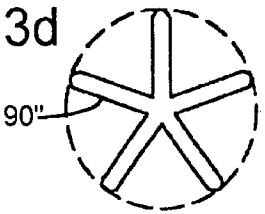
Figure 3E:
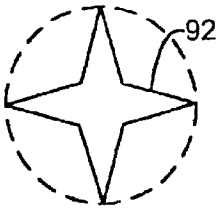
Figure 3F:
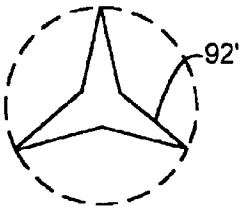
Figure 3G:
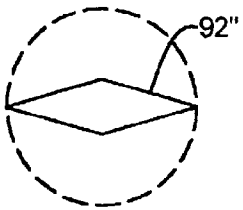
Figure 3H:
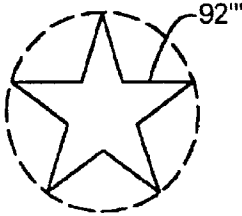

FIGS. 3*b*, 3*c*, and 3*d* illustrate variants 90, 90', and 90" of the post profile. Variant 90 is a three-leg star, variant 90' is a flat bar that functions as a two-legged star. To provide adequate rigidity, variant 90' would require a leg thickness greater than needed for the other variants. Variant 90" is a five-legged star, and other variants with more than 5 legs may be suitable for other embodiments.

FIGS. 3*e*, 3*f*, 3*g*, and 3*h* illustrate variant profiles 92, 92', 92", 92'" having tapered pointed legs, instead of the parallel legs of FIGS. 3*a*–3*d*. Variant 92 is a four-pointed star; variant 92' is a three-pointed star; variant 92" is a two-pointed star or rhombus; and variant 92'" is a five-pointed star, with more than five points being suitable for alternative embodiments. Alternative variants of these star shapes may be provided by employing scalloped channels, with concave arcs defined between points having concave cylindrical surfaces.

Figure 3I:
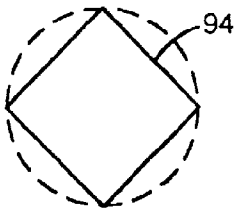
Figure 3J:
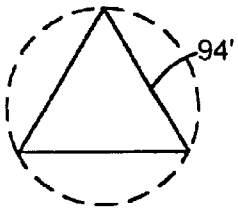

FIGS. 3*i* and 3*j* illustrate variants 94 and 94', each of which are regular polygons, a square and triangle respectively. It is believed that increasing the number of sides beyond 4 will not provide an adequate flame channel or crushabilty of the points of contact between the post and pellet bore, although this may be suitable for some applications.

Figure 3K:
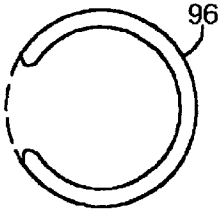
Figure 3L:
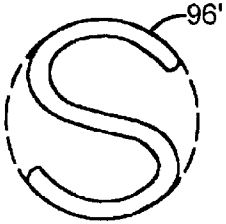

FIGS. 3*k* and 3*l* illustrate a C-shaped variant 96 and an S-shaped variant 96' respectively, These operate to compress elastically in response to a slight interference fit in the manner of roll pins instead of the slight crushing effect on the star and polygon-shaped alternatives illustrated above. Each provides at least one flame channel, and these spring version posts are suited to applications where greater pellet retention forces are needed, so that the pellet is not damaged by the concentrated force at small points of contact that might occur for unusually large caliber applications.

Figure 4C:
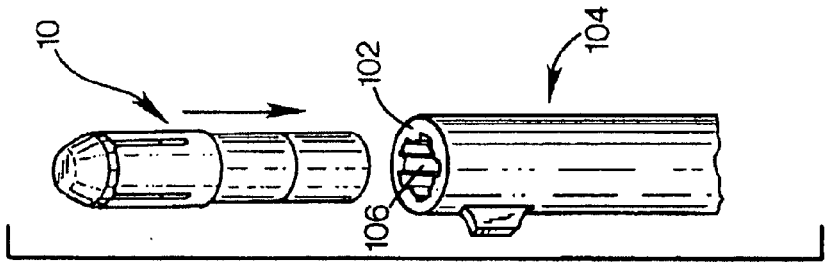
FIGS. 4*a*–4*c* illustrate a sequence of usage according to a preferred embodiment of the invention.
Figure 4B:
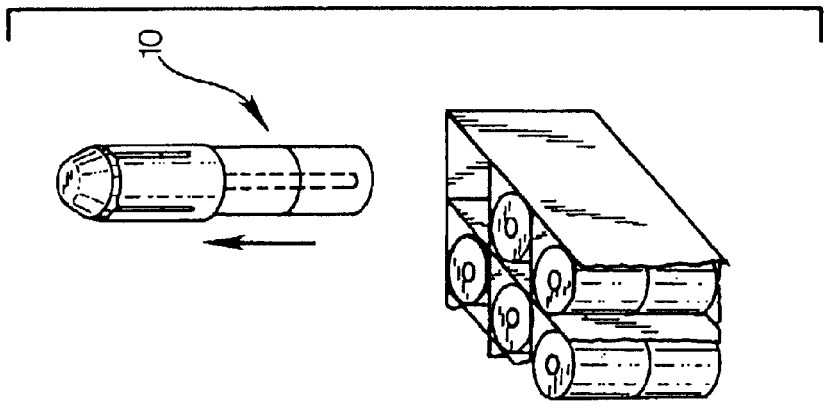
Figure 4A:
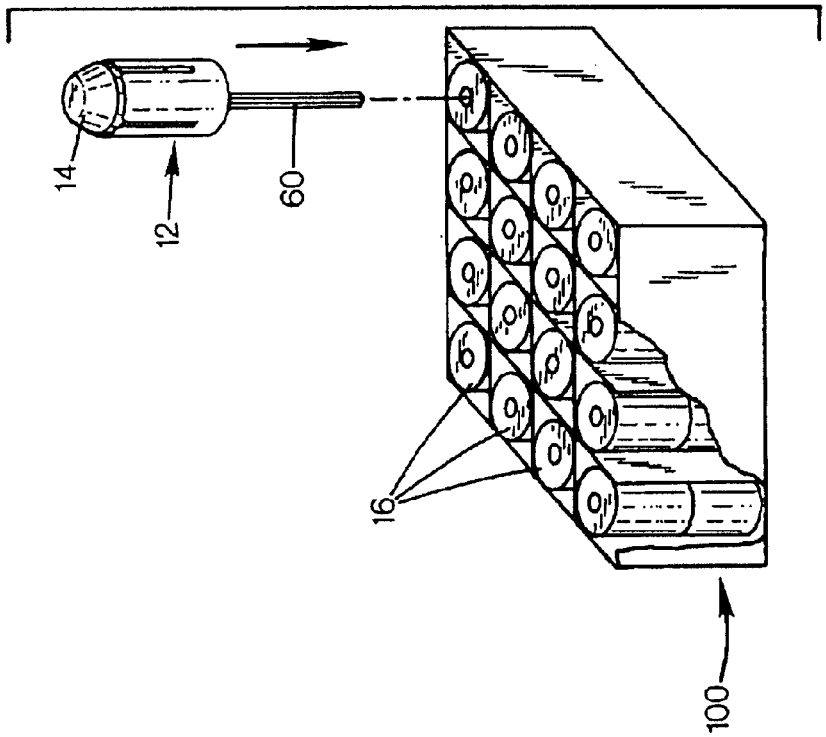

FIGS. 4*a*–4*c* illustrate the method of assembling and loading the sabot assembly 10. In FIG. 4*a*, the sabot 12 has a bullet 14 pre-installed in the petals. An open box 100 of powder pellets 16 is made ready. The pellets are closely packed in an orthogonal array having two layers of the pellets. The pellets are stacked with the bore axes vertical, so that the bores of each stack of two pellets are aligned. The box has "egg-crate" dividers that separate the stacks of pellets, and provide lateral support and alignment for each stack. To connect the pellets to the sabot, the sabot is positioned above a stack of pellets, with the post coaxial with the pellets. The post is inserted downward into the bores of the pellets until the flange presses against the top of the upper pellet. During insertion, slight compression, crushing, or flexion of the post edges occurs, providing an enduring outward pressure against the pellet bores.

The friction generated secures the pellets to the post, and is adequate to resist the weight of the pellets, which are extracted in FIG. 4*b*, which shows the complete sabot assembly. Unlike the pipe-cleaner tool approach used in the prior art, the friction fit does not need to be light enough to allow extraction of the tool/post for each shot. Several of the assemblies may be prepared and stored in readiness for shooting.

In FIG. 4*c*, an assembly is inserted into the muzzle 102 of a rifle barrel 104 having a rifled bore 106. The assembly is then inserted fully into the barrel, aided by a rod, and is ready for firing by an ignition source such as a primer or percussion cap. Upon firing, the pellets rapidly burn, with the burning occurring within the bores of the pellets in the space provided by the post flame channels, and progressing radially outward through the pellets. In response to the rapidly building pressure, the sabot rear edge flares outward, forcefully conforming to the rifling on the barrel's bore. The sabot and bullet are accelerated down the barrel, rotating as the sabot follows the rifling. Upon exit from the barrel, the bullet separates from the sabot, as the petals flare outward in response to air resistance, and the sabot slows rapidly while the bullet continues in ballistic flight. After firing, another assembly may immediately be loaded for firing.

While the above is discussed in terms of preferred and alternative embodiments, the invention is not intended to be so limited. For instance, the components may be sized larger or smaller for use with other conventional calibers of muzzle loading, such as for 0.45, 0.54, and 0.58 caliber rifle barrels. The principles disclosed herein may also be used for larger and small or scale military ordnance where sabots are used. The pellet-engaging post may be used for other sabot designs that hold or connect to the bullet by any means, including those that engage the rifling by means other than petals surrounding the bullet.

What is claimed is:

1. A sabot comprising:

a cylindrical body defining a bore axis;

the body having a first portion extending in a first direction;

the first portion defining a bullet-receiving cup defining a cylindrical chamber space;

the cup being open in the first direction;

a post extending from the body in a second direction opposite the first direction;

a flange extending from the body in the same direction as the post, and terminating at a free edge;

the post and the cylindrical body being internally formed of the same material; and the cylindrical body being a solid element providing a separation between the first direction and the second direction.

2. The sabot of claim 1 wherein the post has a cross section having a plurality of faces extending substantially the length of the post.

3. The sabot of claim 1 wherein the post has a cross section defining a closely circumscribing circle having a selected diameter, and wherein at least a first space is defined outside the cross section and inside the circle.

4. The sabot of claim 1 wherein the post defines at least an elongated passage extending substantially the length of the post.

5. The sabot of claim 1 wherein the post has a star-shaped cross section extending to the free end of the post.

6. A sabot assembly comprising the sabot of claim 1 including a bullet having a cylindrical exterior surface portion closely received within the cup.

7. A sabot assembly comprising the sabot of claim 1 including a powder pellet in the form of a solid cylindrical body formed of gunpowder defining a bore, wherein the post is received in the bore.

8. An ammunition assembly comprising:

a sabot having a bullet-receiving cup facing a first direction and a post extending an opposite direction;

a bullet received in the cup; and a powder pellet in the form of a solid cylindrical body formed of gunpowder defining a bore receiving the post.

9. The assembly of claim 8 wherein the post is closely received within the bore.

10. The assembly of claim 8 wherein the post is received within the bore with an interference fit.

11. The assembly of claim 8 wherein the post has a cross sectional profile that deviates from a circle, and wherein channels are formed between the post and the bore.

12. A sabot comprising:

a cylindrical body defining a bore axis;

the body having a first portion extending in a first direction;

the first portion defining a bullet-receiving cup;

the cup being open in the first direction;

a post formed of flexible material extending from the body in a second direction opposite the first direction; and the post having a cross section with a plurality of faces extending substantially the length of the post.

13. The sabot of claim 12 wherein the post is integrally formed with the cylindrical body of the same material.

14. The sabot of claim 12 wherein the post has a cross section circumscribed by a circle having a selected diameter, and wherein at least a first space is defined outside the cross section and inside the circle.

15. The sabot of claim 12 wherein the post is adapted to be received within a cylindrical bore of a powder pellet in the form of a solid cylindrical body formed of gunpowder.

16. The sabot of claim 12 wherein the post defines at least an elongated passage with respect to a cylindrical form closely circumscribing the post.

17. The sabot of claim 12 wherein the post has a star-shaped cross section.

18. The sabot of claim 1 wherein the cup has sidewalls in the form of a plurality of petals extending from the body and having free edges away from the body, the petals being separated from each other by elongated gaps extending from the body to the free edges.

19. The sabot of claim 1 wherein the sabot is formed of plastic.

20. The sabot of claim 1 wherein the post has a cross sectional profile defining a circle closely encompassing the profile, and wherein the profile includes surface portions that deviate substantially from the circle to define spaces between the surface portions and the circle.

* * * * *